US010450740B2

(12) United States Patent
Magargee

(10) Patent No.: US 10,450,740 B2
(45) Date of Patent: Oct. 22, 2019

(54) ANCHOR BOLT ADAPTOR

(71) Applicant: Light Pole Systems, Inc., Placentia, CA (US)

(72) Inventor: Paul Magargee, Placentia, CA (US)

(73) Assignee: Light Pole Systems, Inc., Placentia, CA (US)

( * ) Notice: Subject to any disclaimer, the term of this patent is extended or adjusted under 35 U.S.C. 154(b) by 0 days.

(21) Appl. No.: 15/876,042

(22) Filed: Jan. 19, 2018

(65) Prior Publication Data

US 2018/0171623 A1 Jun. 21, 2018

Related U.S. Application Data

(60) Provisional application No. 62/428,033, filed on Nov. 30, 2016.

(51) Int. Cl.

| | |
|---|---|
| ***F16B 37/00*** | (2006.01) |
| ***E04B 1/41*** | (2006.01) |
| ***E04H 12/22*** | (2006.01) |
| ***E02D 27/42*** | (2006.01) |
| *E01F 9/681* | (2016.01) |

(52) U.S. Cl.

CPC ..... *E04B 1/4157* (2013.01); *E02D 27/42* (2013.01); *E04H 12/2253* (2013.01); *E01F 9/681* (2016.02)

(58) Field of Classification Search

CPC ... E04B 1/4157; E02D 27/42; E04H 12/2253; E01F 9/681

USPC ..... 411/427; 285/408, 411

See application file for complete search history.

(56) References Cited

U.S. PATENT DOCUMENTS

| | | | | |
|---|---|---|---|---|
| 5,437,482 A * | 8/1995 | Curtis | F16L 23/028 285/148.13 |
| 5,737,801 A * | 4/1998 | Flood | B60B 33/0002 16/30 |
| 5,899,507 A * | 5/1999 | Schroeder | E21B 17/085 285/288.1 |
| 9,281,084 B2 * | 3/2016 | Philippart | F04D 29/628 |

* cited by examiner

*Primary Examiner* — Gary W Estremsky
(74) *Attorney, Agent, or Firm* — Fish IP Law, LLP

(57) ABSTRACT

An anchor bolt adapter (ABA) for adapting a bolt circle of an anchor bolt foundation to a bolt circle of a pole is adapted to secure a base to a foundation. The ABA can comprise a downwardly positioned female threaded opening configured to receive a first one of the anchor bolts and an upwardly positioned female threaded opening configured to receive a threaded connector bolt.

7 Claims, 5 Drawing Sheets

ANCHOR BOLT ADAPTOR

FIELD OF THE INVENTION

The field of the invention is light poles.

BACKGROUND

The background description includes information that may be useful in understanding the present invention. It is not an admission that any of the information provided herein is prior art or relevant to the presently claimed invention, or that any publication specifically or implicitly referenced is prior art.

All publications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

It is well recognized that light pole and the like foundation anchor bolts do not always match the mounting holes in the base plate of the light pole and the like. This can occur for several reasons, including that the anchor bolts were installed incorrectly in the concrete foundation, or that the replacement pole is different from the original. In the past this problem has often been addressed by cutting off and then drilling out the existing anchor bolts, followed by epoxying in the new ones. Other solutions include demoing the existing footing, and then pouring a new footing with correct location of anchor bolts, modifying the base plate plate, or custom making an adaptor plate. All of these solution are problematic from a cost and/or time standpoint.

Relevant patents and applications include U.S. Pat. No. 3,552,698, US20130036679, U.S. Pat. Nos. 4,295,308, 3,837,752, 3,521,413, 3,572,223, 3,630,474, 4,923,319, 7,721,490, 8,037,651, 8,281,531, US20090272053, and US20100293870.

Thus, there remains a need for a system and method that accommodates misaligned anchor bolts and the base plate holes of light or other pole, without having to drill out the existing anchor bolts, or using custom adaptor place.

SUMMARY OF THE INVENTION

The following description includes information that may be useful in understanding the present invention. It is not an admission that any of the information provided herein is prior art or relevant to the presently claimed invention, or that any publication specifically or implicitly referenced is prior art.

The inventive subject matter provides apparatus, systems, and methods in which a coupling block is physically positioned between an upwardly positioned anchor bolt and a horizontally disposed base plate. The coupling block has at least one downwardly positioned, female threaded opening to receive one of the anchor bolts, and either (a) an upwardly positioned female threaded opening to receive a bolt, or (b) a bolt extending directly upwards out of the body of the coupling block. In either case, an upwardly directed bolt has a bottom in the coupling block, whether or not held threadingly in place, passes up through a hole of the base plate, and is secured with a nut positioned above the base plate.

In light pole installation work, misalignment between anchor bolts and bolt circles/openings can require substantial investments in manpower and monetary resources to correct. Conventional anchor bolts are directly anchored into anchor foundations comprising hard materials, such as wood and concrete. As a result, misaligned anchor bolts often require the destruction of the anchor foundation. It is therefore a principal object of the invention to provide a method and apparatus enabling misaligned anchor bolts to be connected to bolt circles on a light pole.

A further objective of the invention is to provide positional adjustment options on an anchor bolt adapter to adapt to a variety of bolt circle configurations associated with different base plates. Yet another objective of the invention is to provide the ability to adjust the rotational position of a light pole in relation to the anchor bolts.

Various objects, features, aspects and advantages of the inventive subject matter will become more apparent from the following detailed description of preferred embodiments, along with the accompanying drawing figures in which like numerals represent like components.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

DETAILED DESCRIPTION

The inventive subject matter provides apparatus, systems, and methods an anchor bolt adaptor (ABA) has at least one downwardly positioned female threaded opening positioned to mate with an upwardly positioned anchor bolt, and either (a) at least one upwardly positioned female threaded opening positioned to mate with a bolt passing upwards through a base plate, or (b) a bolt extending directly upwards out of the body of the coupling block.

As used herein the term "bolt" means a shaft having at least one machine-threaded end to which a nut could be secured. Also as used herein, the term "threaded end" as applied to a bolt means that the bolt has at least some threads within an inch of an actual end of the bolt. Similarly, the term "bolt having one end anchored into the foundation" means a bolt having at least one inch of the actual end of the bolt being anchored, threadingly or non-threadingly, into the foundation.

Figure 1:
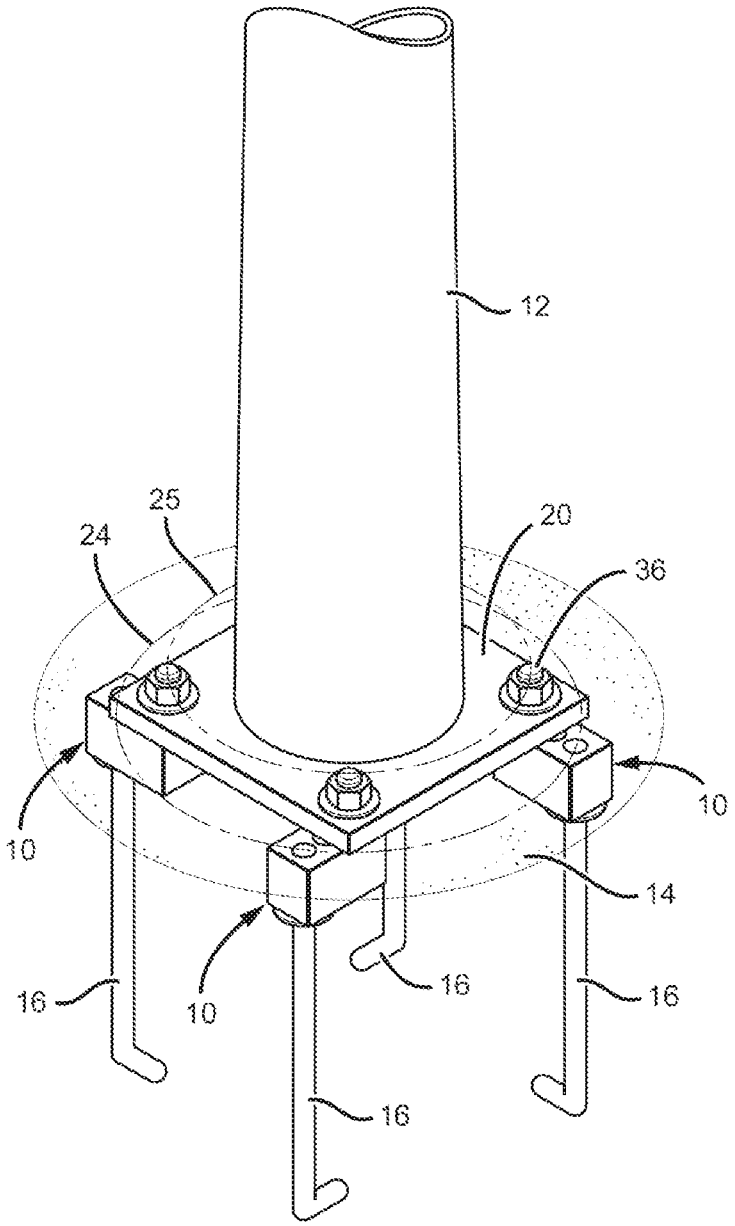
FIG. 1 is a partial view of a pole outfitted with a plurality of inventive Anchor Bolt Adaptors (ABAs).

FIG. 1 is a partial view of a pole outfitted with a plurality of ABAs 10 coupled or connected to a pole 12 to a foundation 14 having a plurality of anchor bolts 16 set therein. Pole 12 includes a horizontally disposed base plate 20 having a plurality of openings 22 formed therein that do not align with anchor bolt(s) 16.

In other words, if footing 14 has 4 anchor bolts set therein a square or rectangle fashion, base plate 20 would have 4 openings 22 formed therein which are arranged in a square or rectangle fashion that does not match that of the anchor bolts 16.

Each ABA 10 is mounted respectively on each of anchor bolts 16 using the internally threaded bore 29 that allows each upwardly facing female threaded opening to best align with their respective openings 22. In some embodiments, a washer 17 can be positioned on the upper face of ABA 10. It is also contemplated that ABA 10 of this invention also functions as a leveling nut for the light pole or the like. It is further contemplated that the ABA 10 of this invention also functions as a spacer between the top of the foundation and bottom of the pole to allow for water drainage from inside the pole.

Bolt 36 is mounted to one of the unused threaded bore 29 that best corrects the offset to allow bolt circle 25 on base plate 20 to be secured to anchor bolts 16. Base plate 20 is mounted on the upper ends of the ABA 10 with bolt 36 extended upwards through the openings in washer 17 or not and through opening 22 formed in base plate 20 secured with washer 32 and threadable nut 30. As previously stated, ABA 10 connects the misaligned anchor bolts to base plate 20.

Figure 2:
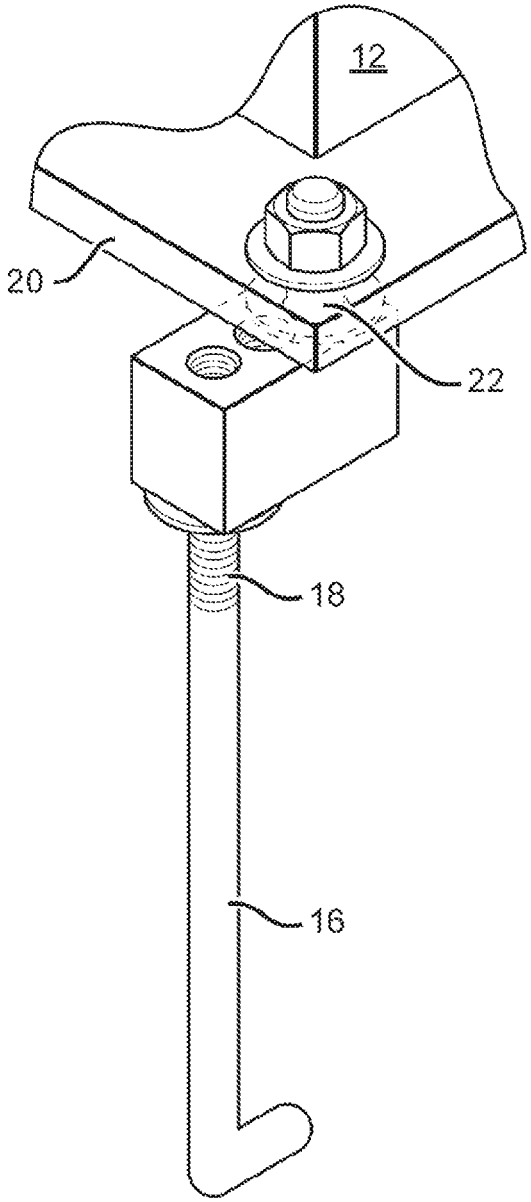
FIG. 2 is a partial section view illustrating the manner in which the Anchor Bolt Adaptor (ABA) of FIG. 1 is positioned between the anchor bolts and the support plate of the pole.

FIG. 2 is a partial section view of one ABA 10 coupled or connected to the base of pole 12 at one end and attached to an anchor bolt 16 at the opposite end. As depicted, anchor bolt 16 is screwed into ABA 10 using anchor bolt threads 18. On the opposite end, ABA 10 is removably coupled to base plate 20 of pole 12 through opening 22.

Figure 3:
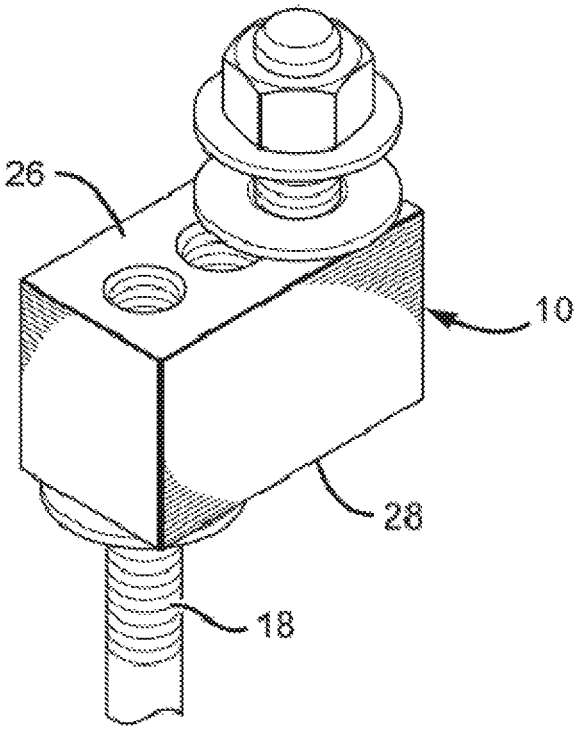
FIG. 3 is a perspective view of the Anchor Bolt Adaptor (ABA) of FIG. 1.

FIG. 3 is a perspective view of one corner of the base of pole 12 and ABA 10 coupled to components allowing ABA 10 to anchor a light pole to a foundation. ABA 10 includes an upper end 26, a lower end 28 and two or more internally threaded bores 29 (discussed below in FIG. 4) extending the distance between the upper and lower ends ABA 10. Anchor bolts 16 can include anchor bolt threads 18 on one end to be mated with the one or more internally threaded bores 29 of ABA 10.

Figure 4:
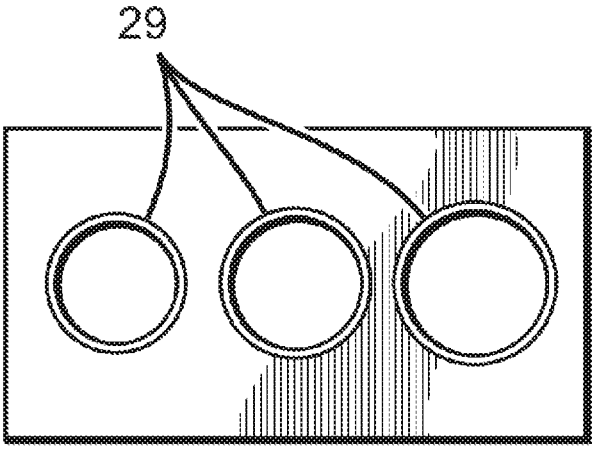
FIG. 4 is a partial top view of the Anchor Bolt Adaptor (ABA) of FIG. 1.

FIG. 4 is a top-down view of ABA 10. ABA 10 includes at least two threaded bores 29. ABA 10 is preferably a rectangular prism shape. Threaded bores 29 can have any combination of diameters on the same ABA 10. For example, threaded bores 29 can be different diameters on the same ABA 10. It is also contemplated that threaded bore 29 can receive various adapters to adapt threaded bore 29 to bolts 36 with smaller diameters. For example, a threaded bore 29 originally adapted to receive a 1 inch diameter bolt can receive an adapter allowing threaded bore 29 to receive a 0.75 inch diameter bolt. However, ABA 10 can be cube-shaped, ellipsoid-shaped, spherical, and any combination thereof. Cross-sections of ABA 10 from the top-down can be rectangular-shaped, oval-shaped, circle-shaped, and any combination thereof.

Figure 5:
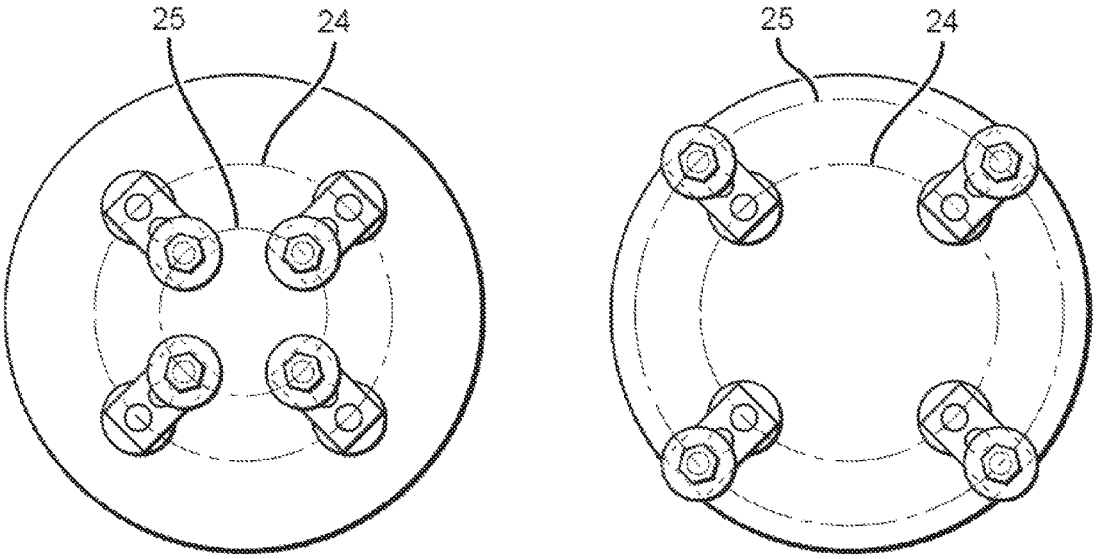
FIG. 5 is a top-down perspective view of original bolt circle (anchor bolts) and a modified bolt circle.

FIG. 5 is a top-down view of pivot circle 24 and bolt circle 25 which defines the maximum reach of ABA 10 and the minimum reach of ABA 10. ABA 10 pivots on a circumference defined by pivot circle 24. The minimum reach of ABA 10 is achieved when 4 ABA 10 are rotated such that the threaded bores 29 that couple with openings 22 are as close together as possible. The maximum reach of ABA 10 is achieved when 4 ABA 10 are rotated such that the threaded bores 29 that couple with openings 22 are as far apart as possible. It is contemplated that the ABA 10 can be rotated in varying degrees to allow it to anchor to base plates 20 with openings 22 falling between the minimum and maximum reach of ABA 10.

Figure 6:
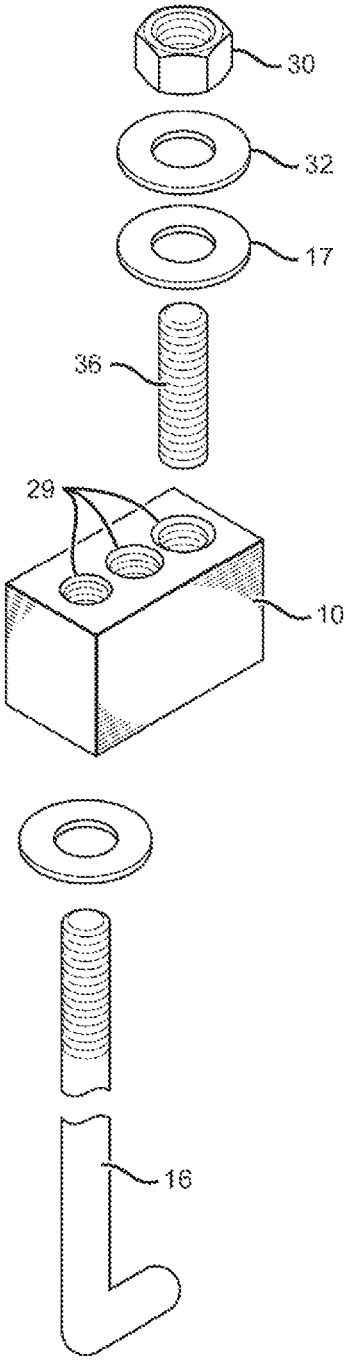
FIG. 6 is an exploded view of components used to anchor the base plate to the foundation.

FIG. 6 depicts an exploded view of components comprising the anchoring mechanism. Anchor bolts 16 couple with threaded bore 29 of ABA 10 on one side of ABA 10. ABA 10 also couples with bolt 36 on the opposite side of ABA 10 via threaded bore 29. A second end of bolt 36 can be passed through the centers of washer 17, base plate 20 (not depicted), and washer 32 to secure ABA to base plate 20. Threadable nut 30 couples with the second end of bolt 36 to secure base plate 20 to the foundation 14.

Thus, it can be seen that a unique ABA has been provided which accomplishes at least all of its stated objectives.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A system for adapting a bolt circle of an anchor bolt foundation to a bolt circle of a pole, comprising:

wherein the bolt circle of the anchor bolt foundation includes a plurality of horizontally spaced-apart, upwardly directed anchor bolts having externally threaded upper ends, arranged according to a first configuration;

the bolt circle of the pole including a base portion with a plurality of openings formed therein according to a second configuration;

a plurality of anchor bolt adapters, each of the anchor bolt adapters comprising:

a downwardly positioned female threaded opening configured to receive one of the plurality of anchor bolts; and an upwardly positioned female threaded opening configured align with a corresponding one of the plurality of openings and to receive a threaded connector bolt that also is passed through the corresponding one of the plurality of openings, wherein the upwardly positioned female threaded opening is horizontally spaced apart from the downwardly positioned female threaded opening.

2. The system of claim 1, each of the plurality of anchor bolt adapters further comprising an intermediate upwardly or downwardly positioned female threaded opening, horizontally spaced between the downwardly positioned female threaded opening and the upwardly positioned female threaded opening.

3. The system of claim 1, wherein the downwardly positioned female threaded opening extends all the way from an upper surface of the anchor bolt adapter to a lower surface of the ABA.

4. The system of claim 1, wherein a center of the downwardly positioned, female threaded opening is spaced apart from a center of the an upwardly positioned female threaded opening by at least 3 cm.

5. The system of claim 1, wherein the anchor bolt adapter comprises a forged metal alloy.

6. The system of claim 1, wherein the downwardly positioned female threaded opening has a different gauge from the upwardly positioned female threaded opening.

7. The system of claim 1, further comprising the pole having the bolt circle of the pole.

* * * * *